US008893821B2

(12) United States Patent
Schwefe

(10) Patent No.: US 8,893,821 B2
(45) Date of Patent: Nov. 25, 2014

(54) APPARATUS AND METHOD FOR TOOL FACE CONTROL USING PRESSURE DATA

(75) Inventor: Thorsten Schwefe, Virginia Water (GB)

(73) Assignee: Baker Hughes Incorporated, Houston, TX (US)

( * ) Notice: Subject to any disclaimer, the term of this patent is extended or adjusted under 35 U.S.C. 154(b) by 308 days.

(21) Appl. No.: 13/448,682

(22) Filed: Apr. 17, 2012

(65) Prior Publication Data

US 2012/0267169 A1 Oct. 25, 2012

Related U.S. Application Data

(60) Provisional application No. 61/477,760, filed on Apr. 21, 2011.

(51) Int. Cl.
*E21B 47/02* (2006.01)
*E21B 47/024* (2006.01)

(52) U.S. Cl.
CPC ..... *E21B 47/024* (2013.01)
USPC ..... 175/45; 175/61; 705/12

(58) Field of Classification Search
USPC ..... 175/45, 61; 702/7, 12
See application file for complete search history.

(56) References Cited

U.S. PATENT DOCUMENTS

| | | | | |
|---|---|---|---|---|
| 5,381,092 | A | 1/1995 | Freedman | |
| 6,047,784 | A | 4/2000 | Dorel | |
| 6,648,082 | B2 | 11/2003 | Schultz et al. | |
| 6,722,450 | B2 | 4/2004 | Schultz et al. | |
| 6,817,425 | B2 | 11/2004 | Schultz et al. | |
| 6,868,920 | B2 | 3/2005 | Hoteit et al. | |
| 7,357,197 | B2 | 4/2008 | Schultz et al. | |
| 7,823,661 | B2 | 11/2010 | Mintchev et al. | |
| 8,095,317 | B2 * | 1/2012 | Ekseth et al. | 702/7 |
| 8,185,312 | B2 * | 5/2012 | Ekseth et al. | 702/7 |
| 2004/0118612 | A1 | 6/2004 | Haci et al. | |
| 2007/0030007 | A1 | 2/2007 | Moore | |
| 2009/0166091 | A1 | 7/2009 | Matthews et al. | |
| 2010/0126770 | A1 | 5/2010 | Sugiura | |
| 2010/0259415 | A1 | 10/2010 | Strachan et al. | |

FOREIGN PATENT DOCUMENTS

WO WO2010039342 A1 4/2010

OTHER PUBLICATIONS

International Search Report and Written Opinion dated Nov. 9, 2012 for International Application No. PCT/US2012/034467.
Jaako, I. et al.; "Tool Condition Monitoring in Gundrilling Using Feed Force and Torque Measurements," 19th International Conference on Production Research, 2006, pp. 1-6.
Muritala, Lateef et al.; "Improved Horizontal Well Placement and Performance Using a Bit Inclination Measurement Tool," SPE 65114, SPE European Petroleum Conference, Paris, France, Oct. 24-25, 2000, pp. 1-18.

* cited by examiner

*Primary Examiner* — William P Neuder
(74) *Attorney, Agent, or Firm* — Cantor Colburn LLP

(57) ABSTRACT

A method, apparatus and computer-readable medium for drilling a wellbore is disclosed. A fluid is pumped to rotate a drilling assembly at an end of a drill string in the wellbore. A plurality of measurements of pressure of the fluid is obtained. A standard deviation of the mud pressure is estimated from the plurality of fluid pressure measurements, and a variation of a tool face angle of the drilling assembly to the pumped fluid is estimated from a comparison of the estimated standard deviation of pressure to a selected criterion. A drilling parameter can be altered to drill the wellbore based on the estimated variation of the tool face angle.

20 Claims, 6 Drawing Sheets

APPARATUS AND METHOD FOR TOOL FACE CONTROL USING PRESSURE DATA

CROSS-REFERENCE TO RELATED APPLICATIONS

This application claims priority to U.S. Provisional Application No. 61/477,760, filed Apr. 21, 2011.

BACKGROUND OF THE DISCLOSURE

1. Field of the Disclosure

The present disclosure is related to directional drilling and includes methods for determining a tool face angle of a drill string drilling a wellbore.

2. Description of the Related Art

In petroleum exploration and drilling, it is often desirable to drill a wellbore into a hydrocarbon reservoir at an angle rather than drilling down vertically to the reservoir. When drilling an angled wellbore, at some point it becomes necessary to change the direction of a drill string drilling the wellbore from its original vertical orientation. This practice is known as directional drilling. The rate of change of a drilling direction can be controlled by an operator or program that orients a drill bit at the end of the drill string toward a selected direction. A useful parameter for determining drilling direction is known as the tool face angle or orientation of the drill string along the azimuth of the drill string. Due to drilling dynamics, the drill string can twist and oscillate, thereby causing uncertainty in the operator's knowledge of the tool face angle and making it difficult to control the drilling direction. Therefore, the present disclosure provides a method and apparatus for estimating a tool face angle of a drill string downhole.

SUMMARY OF THE DISCLOSURE

In one aspect, the present disclosure provides a method of drilling a wellbore, the method including: supplying a fluid to a drilling assembly in the wellbore; obtaining a plurality of measurements of fluid pressure of the supplied fluid; estimating a standard deviation of the fluid pressure from the plurality of the measurements of the fluid pressure; estimating a variation of a tool face angle of the drilling assembly using the estimated standard deviation of the fluid pressure; and altering a drilling parameter based on the estimated variation of the tool face angle to drill the wellbore.

In another aspect, the present disclosure provides an apparatus for drilling a wellbore, the apparatus including: a drilling assembly in the wellbore; a pressure sensor configured to obtain measurements of pressure of a fluid flowing through the drilling assembly; and a processor configured to: estimate a standard deviation of the pressure measurements of the fluid flowing through the drilling assembly, estimate a variation of a tool face angle of the drilling assembly from the estimated standard deviation, and alter a drilling parameter based on the estimated variation of the tool face angle to drill the wellbore.

In yet another aspect, the present disclosure provides a computer-readable medium having instructions stored therein which enable a processor having access to the instructions to perform a method of drilling a wellbore, the method including: receiving measurements of pressure of a fluid supplied to a drilling assembly deployed in the wellbore; estimating a standard deviation of the measurements of pressure; estimating a variation of a tool face angle of the drilling assembly from the estimated standard deviation of measurements of pressure; and altering a drilling parameter based on the estimated variation of the tool face angle of the drilling assembly to drill the wellbore.

In another aspect, the present disclosure provides a method of estimating a variation of a tool face angle of a drilling assembly in a wellbore, the method including: obtaining pressure measurements of a fluid flowing through the drilling assembly using a sensor; estimating a standard deviation of the pressure measurements, and estimating a variation of a tool face angle of the drilling assembly from the estimated standard deviation.

Examples of certain features of the apparatus and method disclosed herein are summarized rather broadly in order that the detailed description thereof that follows may be better understood. There are, of course, additional features of the apparatus and method disclosed hereinafter that will form the subject of the claims.

BRIEF DESCRIPTION OF THE DRAWINGS

For detailed understanding of the present disclosure, references should be made to the following detailed description, taken in conjunction with the accompanying drawings, in which like elements have been given like numerals and wherein.

DETAILED DESCRIPTION OF THE DISCLOSURE

Figure 1:
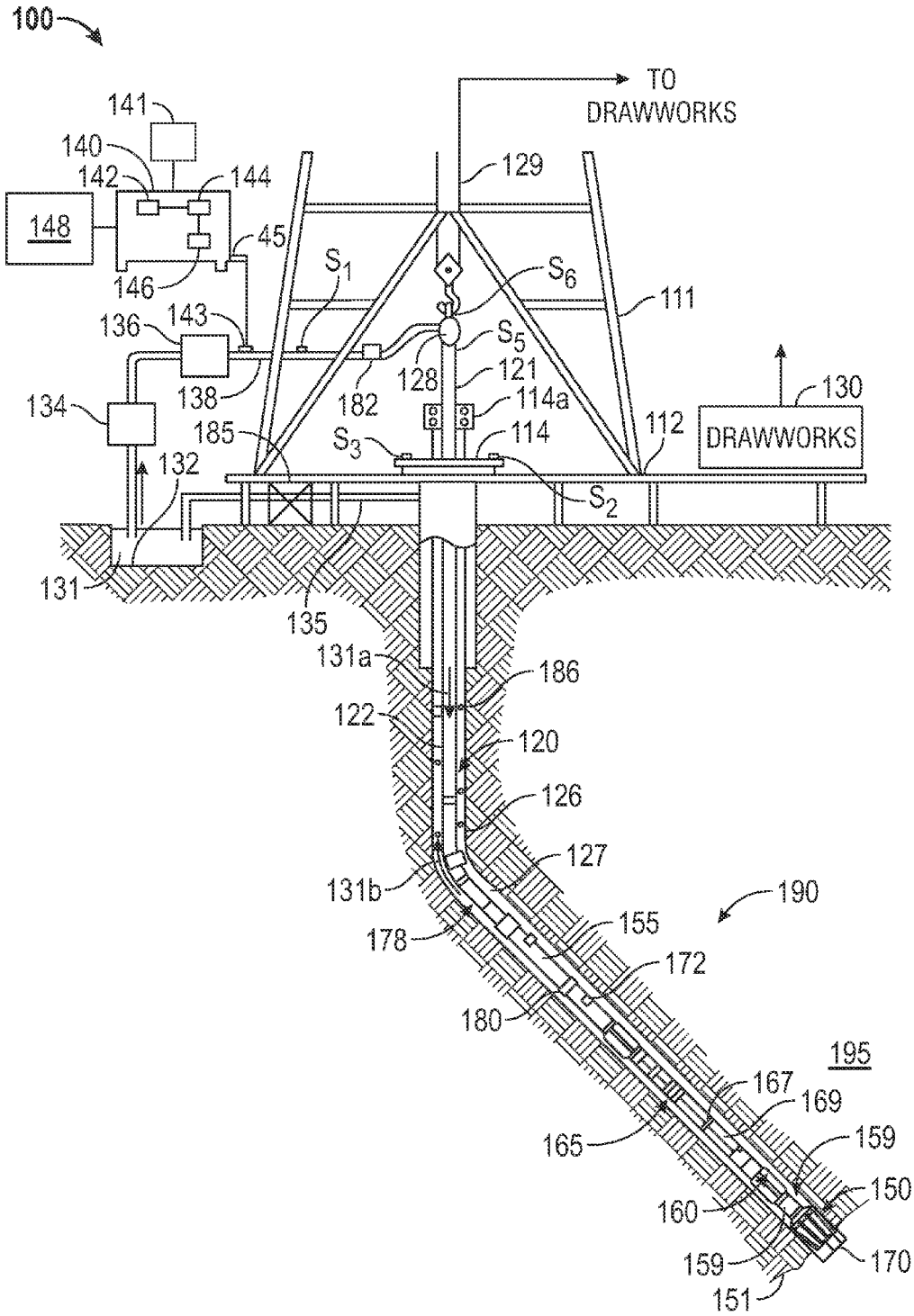
FIG. 1 is a schematic diagram of an exemplary drilling system for drilling a wellbore using an apparatus that can be operated according to the exemplary methods disclosed herein.

FIG. 1 is a schematic diagram of an exemplary drilling system 100 for drilling a wellbore using an apparatus that can be operated according to the exemplary methods disclosed herein. Exemplary drilling system 100 includes a drill string 120 that includes a drilling assembly or bottomhole assembly ("BHA") 190 conveyed in a wellbore 126. The drilling system 100 includes a conventional derrick 111 erected on a platform or floor 112 which supports a rotary table 114 that is rotated by a prime mover, such as an electric motor (not shown), at a desired rotational speed. A tubing (such as jointed drill pipe) 122 having the drilling assembly 190 attached at its bottom end extends from the surface to the bottom 151 of the wellbore 126. A drill bit 150, attached to drilling assembly 190, disintegrates the geological formations when it is rotated to drill the wellbore 126. The drill bit 150 may include a button 170 or other suitable device for indicating contact between the drill bit 150 and the wellbore bottom 151. The drill string 120 is coupled to a drawworks 130 via a Kelly joint 121, swivel 128 and line 129 through a pulley. Drawworks 130 is operated to control the weight on bit ("WOB"). The drill string 120 can be rotated by a top drive (not shown) instead of by the prime mover and the rotary table 114. The operation of the drawworks 130 is known in the art and is thus not described in detail herein.

In one aspect, a suitable drilling fluid 131 (also referred to as "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* from the drilling tubular discharges at the wellbore bottom 151 through openings in the drill bit 150. The returning drilling fluid 131*b* circulates uphole through the annular space 127 between the drill string 120 and the wellbore 126 and returns to the mud pit 132 via a return line 135 and drill cutting screen 185 that removes the drill cuttings 186 from the returning drilling fluid 131*b*. A sensor $S_1$ in line 138 provides information about the fluid flow rate. A surface torque sensor $S_2$ and a sensor $S_3$ associated with the drill string 120 provide information about the torque and the rotational speed of the drill string 120. Rate of penetration of the drill string 120 can be determined from the sensor $S_5$, while the sensor $S_6$ can provide the hook load of the drill string 120. Additionally, pressure sensor 182 in line 138 is configured to measure a mud pressure in the drill string.

In some applications, the drill bit 150 is rotated by rotating the drill pipe 122. However, in other applications, a downhole motor 155 (mud motor) disposed in the drilling assembly 190 also rotates the drill bit 150 via mud pumped through the mud motor. The rate of penetration ("ROP") for a given drill bit and BHA largely depends on the weight-on-bit (WOB) or the thrust force on the drill bit 150 and its rotational speed.

A surface control unit or controller 140 receives signals from downhole sensors and devices via a sensor 143 placed in the fluid line 138 and signals from sensors $S_1$-$S_6$ and pressure sensor 182 and other sensors used in the system 100 and processes such signals according to programmed instructions provided from a program to the surface control unit 140. The surface control unit 140 displays desired drilling parameters and other information on a display/monitor 141 that can be utilized by an operator to control the drilling operations. The surface control unit 140 can be a computer-based unit that can include a processor 142 (such as a microprocessor), a storage device 144, such as a solid-state memory, tape or hard disc, and one or more computer programs 146 in the storage device 144 that are accessible to the processor 142 for executing instructions contained in such programs to perform the methods disclosed herein. The surface control unit 140 can further communicate with a remote control unit 148. The surface control unit 140 can process data relating to the drilling operations, data from the sensors and devices on the surface, mud pressure measurements and data received from downhole and can control one or more operations of the downhole and surface devices. Alternately, the methods disclosed herein can be performed at a downhole processor 172.

The drilling assembly 190 may also contain formation evaluation sensors or devices (also referred to as measurement-while-drilling, "MWD," or logging-while-drilling, "LWD," sensors) determining resistivity, density, porosity, permeability, acoustic properties, nuclear-magnetic resonance properties, corrosive properties of the fluids or formation downhole, salt or saline content, and other selected properties of the formation 195 surrounding the drilling assembly 190. Such sensors are generally known in the art and for convenience are generally denoted herein by numeral 165. The drilling assembly 190 can further include a variety of other sensors and communication devices 159 for controlling and/or determining one or more functions and properties of the drilling assembly (such as velocity, vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc. In addition, the drilling assembly 190 can also include one or more accelerometers 169 or equivalent devices for estimating an orientation of the drill string as well as stabilizers 167 for controlling an orientation of the drill bit. A suitable telemetry sub 180 using, for example, two-way telemetry, is also provided as illustrated in the drilling assembly 190 and provides information from the various sensors and to the surface control unit 140.

Figure 2:
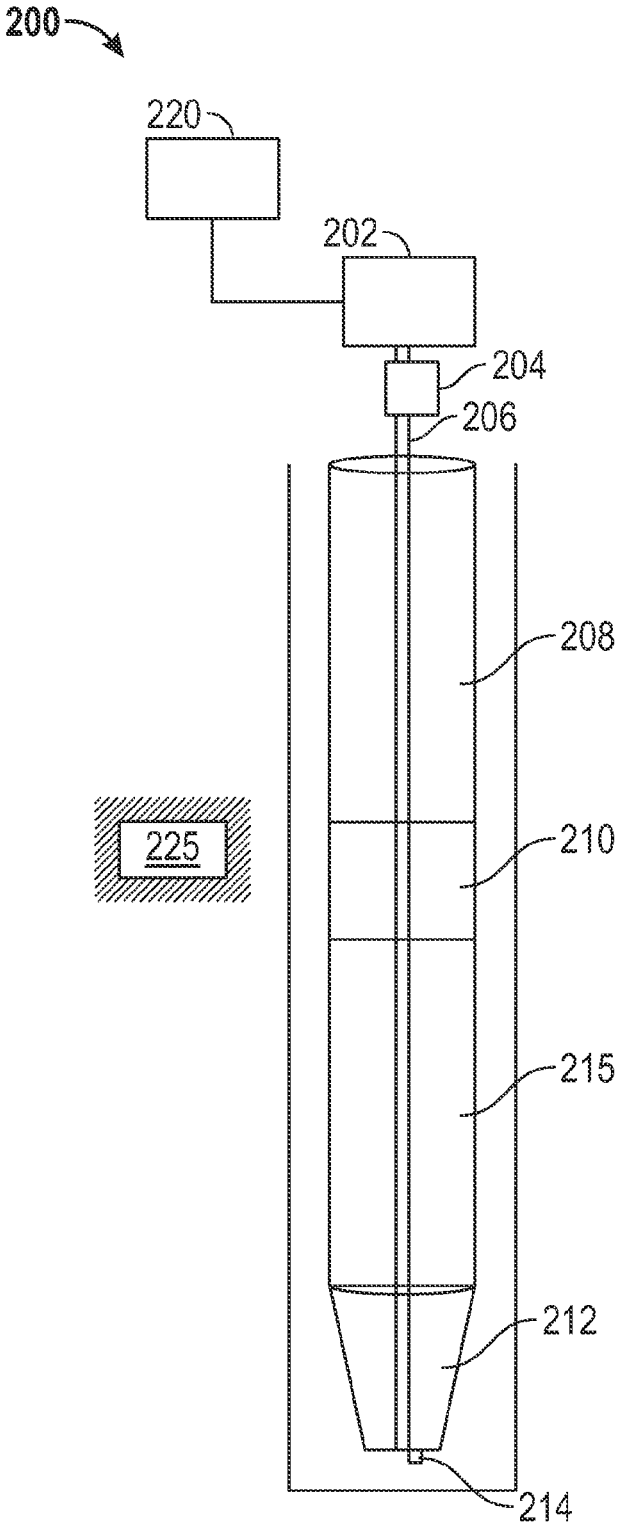
FIG. 2 shows a diagram of an exemplary drill string apparatus of the present disclosure for drilling a wellbore according to the methods described herein.

FIG. 2 shows a diagram of an exemplary drill string apparatus 200 of the present disclosure for drilling a wellbore according to the methods described herein. The apparatus includes a drill string 208 having a drilling assembly 215 coupled to a bottom end of drill string 208. Motor 210 is coupled to the drill string 208 and the drilling assembly 215 and rotates a drill bit 212 at a bottom end of the drilling assembly when a fluid such as mud flows through the motor. Mud is pumped through a fluid line 206 in the drill string to supply the mud to the mud motor 210 to thereby rotate drill bit 212. The mud is pumped via a mud pump 202 typically at a surface location. A mud pressure sensor 204 coupled to the fluid line 206 obtains a measurement of pressure of the mud being pumping through the drill string. The obtained measurement of mud pressure may be sent to a processor 220, such as the exemplary processor 142 of control unit 140 in FIG. 1. Exemplary contact indication device 214 is configured to determine a contact between the drill bit 214 and the formation at a bottom of the wellbore. The contact indication device 214 is depressed when the drill bit is in contact with the formation to indicate an on-bottom condition. The contact indication device is released when the drill bit is freely-rotating or otherwise not in contact with the formation. The indication device can be any suitable form of on-bottom/off-bottom indicator device. A signal from the contact indication device indicating an off-bottom or on-bottom condition may be sent to the exemplary processor 202 alongside the pressure measurements to indicate whether an obtained pressure measurement is related to an on-bottom condition or an off-bottom condition of the drill bit and/or the drilling assembly. In one aspect, measurements for the off-bottom condition may be obtained during a calibration interval. The processor 142 in one aspect determines a difference in mud pressure between on-bottom and off-bottom conditions of the drilling assembly. The processor may also estimate a tool face response or variation using the obtained measurements and the methods described herein. The response may be a variation of the tool face angle or an oscillation parameter of the tool face angle such as amplitude of oscillation. The response may in one aspect be considered either acceptable or not acceptable, based on a comparison of the estimated standard deviation of the mud pressure to a selected pressure criterion. The processor may also alter a drilling parameter of the drill string using the estimated tool face response or an estimated standard deviation of the pressure measurements. A drilling parameter may include, for example, a weight-on-bit, fluid flow rate, pressure, temperature, rate of penetration, azimuth, tool face, drill bit rotation penetration, etc.

In various embodiments, the drill bit 214 can be oriented so as to change a direction of drilling which may include changing from drilling straight ahead of the drill string to drilling into a wall of the formation 225 using, for example, stabilizers 167. An operator typically orients the drill bit to drill at a selected direction to achieve a selected build-up rate (BUR). BUR is an indication of a degree of turn in a wellbore over a given drilling distance and is typically measured in degrees of turn per 100 ft or, alternatively, per 30 meters. The ability of an operator to achieve the selected BUR depends in part on the behavior of the tool face or the degree of variation of the tool face angle of the drilling assembly. The actual build-up rate is related to an expected BUR by the tool face angle, as shown below:

$$\text{Actual BUR}=\text{Expected BUR}*\cos(\text{toolface angle}) \quad \text{Eq. (1)}$$

The tool face angle is a by-product of operation of the drill bit. A well-behaved tool face has a low level of oscillations (for example, +/−10° about a selected drilling angle. For the exemplary well-behaved tool face (having the exemplary +/−10° variation) drilling at an expected BUR of 10°/100 ft, $$\text{Actual BUR}=10°/100\text{ ft}*\cos(10°)=9.8°/100\text{ ft} \quad \text{Eq. (2)}$$

Therefore a well-behaved drill bit substantially maintains the selected drilling angle and achieves a desired BUR for the drill string. A poorly-behaved drill bit may a large range of oscillations (for example, +/−70°) about a selected drilling angle. For the exemplary poorly-behaved drill bit, $$\text{Actual BUR}=10°/100\text{ ft}*\cos(70°)=3.4°/100\text{ ft} \quad \text{Eq. (3)}$$

which is significantly different than the expected BUR of 10°/100 ft. Therefore, a poorly-behaved drill bit and/or bottomhole assembly generally does not maintain a selected drilling angle and generally does not achieve the selected BUR.

Figure 3:
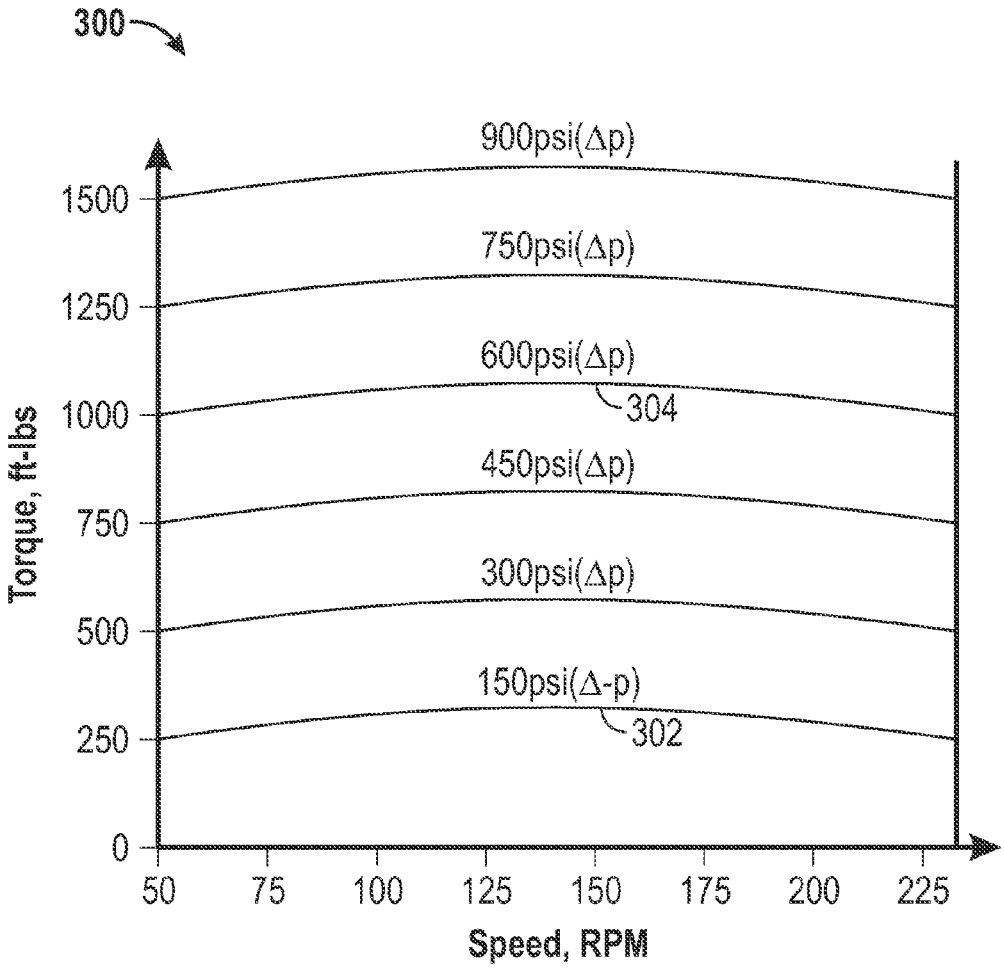
FIG. 3 shows an exemplary graph relating torque on a drill string to drill bit speed.

Oscillations or variations in the tool face angle are related to various drilling parameters, such as mud pressure at the motor driving the drill bit, torque, and rotational speed of the drill bit. FIG. 3 shows an exemplary graph relating torque on a drill string to drill bit speed. Torque is shown along the y-axis in ft-lbs and rotation drill bit speed is shown along the x-axis in revolutions per minute (RPM). Curves are shown for pressure differentials AP of 150 psi, 300 psi, 450 psi, 600 psi, 750 psi and 900 psi. At a selected mud pressure differential in FIG. 3, increasing speed of rotation of the drill bit typically reduces the torque on the drill string. At a constant speed (i.e., 150 RPM), a low mud pressure differential 302 driving the drill bit exerts a low torque on the drill string, and a high mud pressure differential 304 driving the drill bit exerts a high torque on the drill string.

Figure 4:
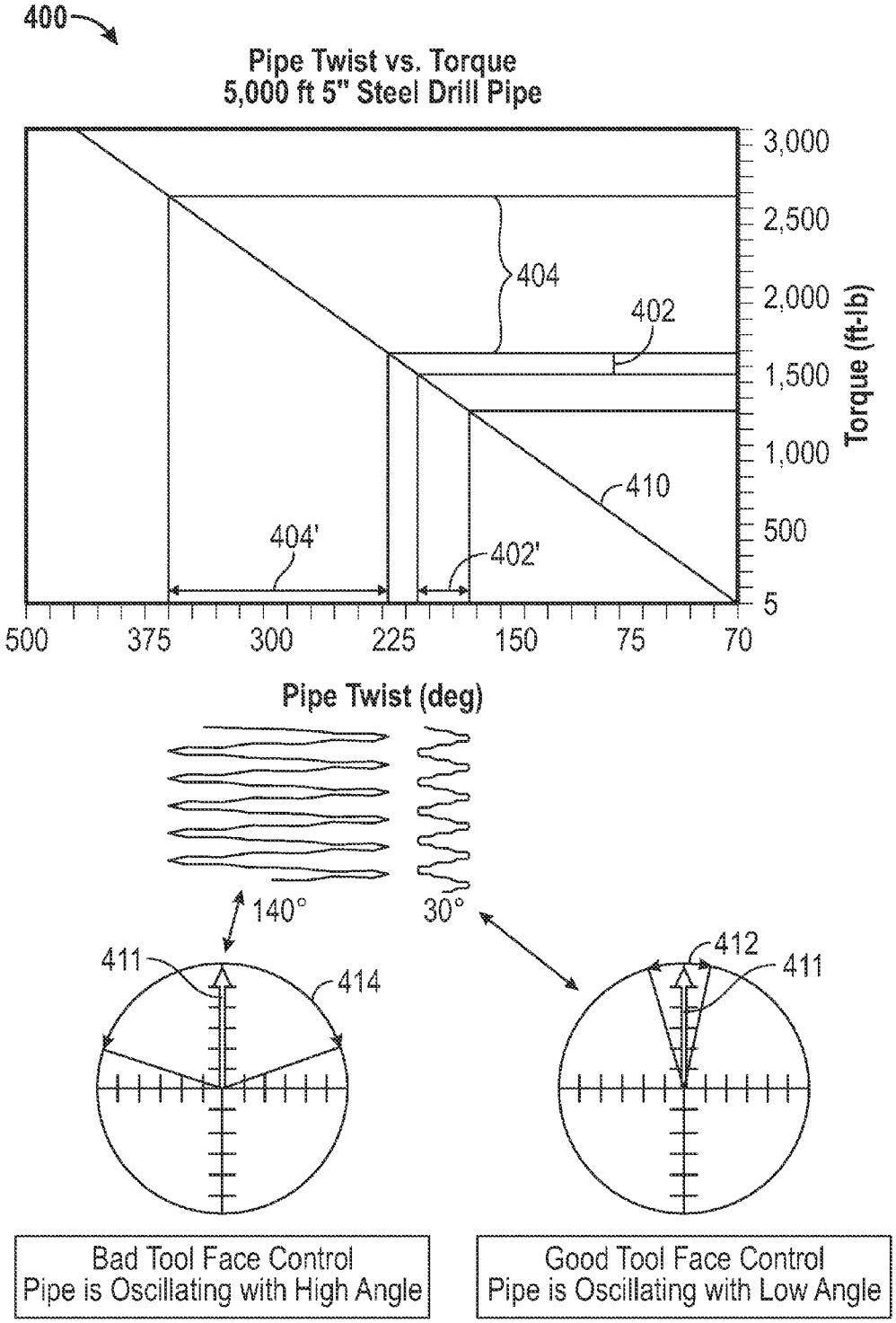
FIG. 4 shows a graph illustrating an exemplary relationship between torque on a drill string and tool face angle.

FIG. 4 shows a graph 400 illustrating an exemplary relationship between torque on a drill string and tool face angle. Graph 400 shows pipe twist (or a change in tool face angle) vs. a torque applied to a 5000 foot 5" steel drill pipe. Pipe twist is shown along the x-axis in degrees. Torque is shown along the y-axis in foot-pounds. The amount of torque and the amount of pipe twist are directly related as shown by line 410. Exemplary low torque variation values 402 and exemplary high torque variation values 404 are shown. A drill string with a low torque variation, as shown by exemplary range 402, typically experiences small variations in the pipe twist as shown by exemplary range 402. From the torque/tool face angle relationship 410, the applied torque variation from about 1250 ft-lbs to about 1500 ft-lbs creates a pipe twist from about 170 degrees to about 200 degrees. Tool face angle for a low torque variation operation is shown by the oscillation pattern 402'. A drill string with a high torque variations, a shown by exemplary range 404, experiences large variations in pipe twist, as shown by exemplary range 404. From torque/tool face angle relationship 410, the torque variation from about 1600 ft-lbs to about 2700 ft-lbs creates a pipe twist from about 230 degrees to about 370 degrees. Tool face angle for a high torque variation operation is shown by the oscillation pattern 404'. Cross-sectional views of the drill string are shown below graph 400. Drill string 412 shows a well-behaved tool face related to the low torque condition, the tool face oscillating over a range of about 30° around a selected tool face orientation 411. Drilling with low-level oscillations of the tool face angle enables the operator to obtain a reasonable degree of control over BUR and other directional drilling parameters. Drill string 414 shows a poorly-behaved tool face related to the high torque condition, the tool face oscillating over a range of about 140° around a selected tool face orientation 411. Drilling with high-level oscillations of the tool face angle makes it difficult to control the direction of drilling.

The present disclosure relates a variation of a tool face angle to a fluid (mud) pressure variable that can be estimated while drilling. Mud pressure measurements are obtained for off-bottom and on-bottom drilling conditions of the drilling assembly and a pressure difference is estimated between the obtained measurements:

$$\Delta P=P_{on\text{-}bottom}-P_{off\text{-}bottom} \quad \text{Eq. (4)}$$

A plurality of pressure differences are obtained over a selected time interval and a standard deviation of ΔP is estimated using:

$$\sigma=\sqrt{\frac{1}{N}\sum_{i=1}^{N}(x_i-\bar{x})^2} \quad \text{Eq. (5)}$$

where $$\bar{x}=\frac{1}{N}\sum_{i=1}^{N}x_i \quad \text{Eq. (6)}$$

wherein the x variable represents pressure differences obtained using Eq. (4). In an exemplary embodiment, standard deviation values are estimated every 5 to 30 minutes. Pressure values used to estimate a particular standard deviation value may be obtained at selected intervals ranging from about 50 per second to about 1 every 20 seconds. The range of time durations for standard deviation measurements and fluid pressure measurements are only exemplary and are not meant as a limitation of the disclosure. Any suitable time ranges for determining the standard deviation and pressure measurements can be used. In general, estimated standard deviation values are compared to a selected pressure criterion to determine a response or variation of the tool face angle to the pumped fluid, such as a range over which the tool face angle varies in response to the pressure of the pumped fluid or an acceptability or non-acceptability of oscillations of the tool face angle. If the standard deviation of the pressure is less than a selected criterion, then the response of the tool face angle may be considered acceptable and drilling may be continued. If the standard deviation of the pressure is greater than the selected criterion, then the response of the tool face may be considered unacceptable for drilling purposes and the operator or program may take an action to affect the drilling. The action may include stopping drilling or altering a drilling parameter such as, for example, a weight-on-bit, fluid flow rate, pressure, temperature, rate of penetration, azimuth, tool face, drill bit rotation penetration, etc. Typically, standard deviation values less than about 50 psi indicate a well-behaved tool face angle having small oscillations and that no action is to be taken, while standard deviation values greater than about 50 psi indicate a poorly-behaved tool face angle and that one or more actions are to be taken. In another aspect, the present criterion may be a range of values within a low value limit and a high value limit. If the standard deviation of the pressure is less than the low value limit, then no action is to be taken. If the standard deviation of the pressure is greater than the high value limit, then one of the exemplary actions is taken to affect the drilling. An operator may be altered when standard deviation values are between the lower and upper limits. In various embodiments, the range may be between 50 psi and 75 psi. This range typically is dependent on the ductility of the drill string and therefore may change depending on various drill string parameters. In another embodiment, the standard deviation can be compared to the range of values after a well is drilled to evaluate the performance of the drill bit and/or bottomhole assembly. The post-evaluation can identify drilling problems after the well has been drilled to be used for future purposes.

Figure 5:
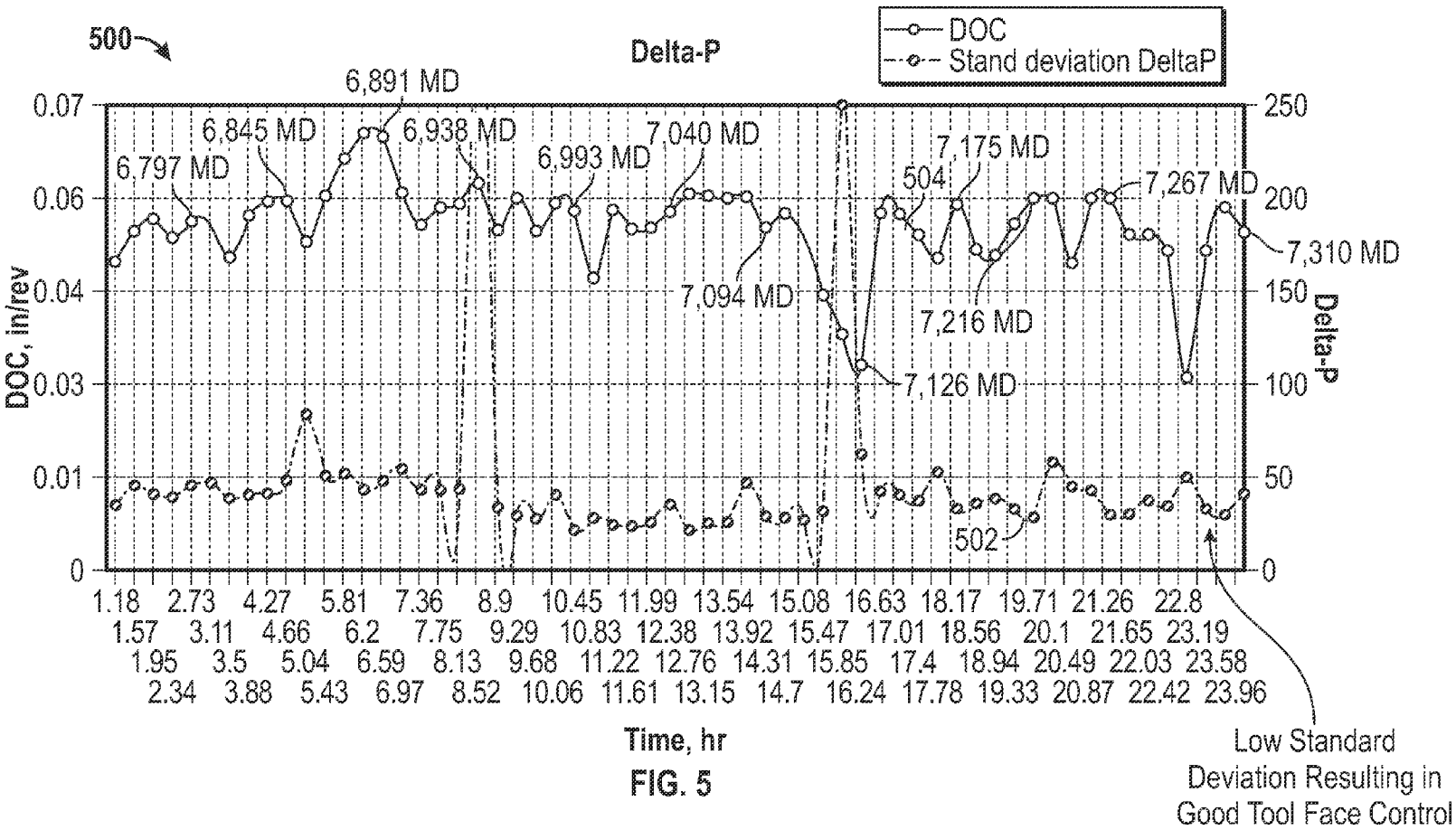
FIG. 5 shows a graph of exemplary parameters related to a low-variation tool face angle obtained using the methods described herein.

FIG. 5 shows a graph 500 of exemplary parameters related to a low-variation tool face angle obtained using the methods described herein. The time duration of drilling is shown along the x-axis in hours. A first curve 502 indicates standard deviation of mud pressure difference ($\sigma_{\Delta P}$) and its numerical values are indicated on the y-axis at the right-hand side of the graph. A second curve 504 indicates depth of cut (DOC) and its numerical values are indicated on the y-axis at the left-hand side of the graph. Values for first curve 502 lie mostly at or below 50 psi, indicating low-level tool face oscillations and a well-behaved drill bit. For a drill bit having these low-level tool face oscillations, typically no action is taken to change drilling parameters. Second curve 504 shows a depth-of-cut averaging about 0.05 inches per revolution that corresponds to the low-level variations of the tool face. The depth-of-cut is substantially constant over the time range.

Figure 6:
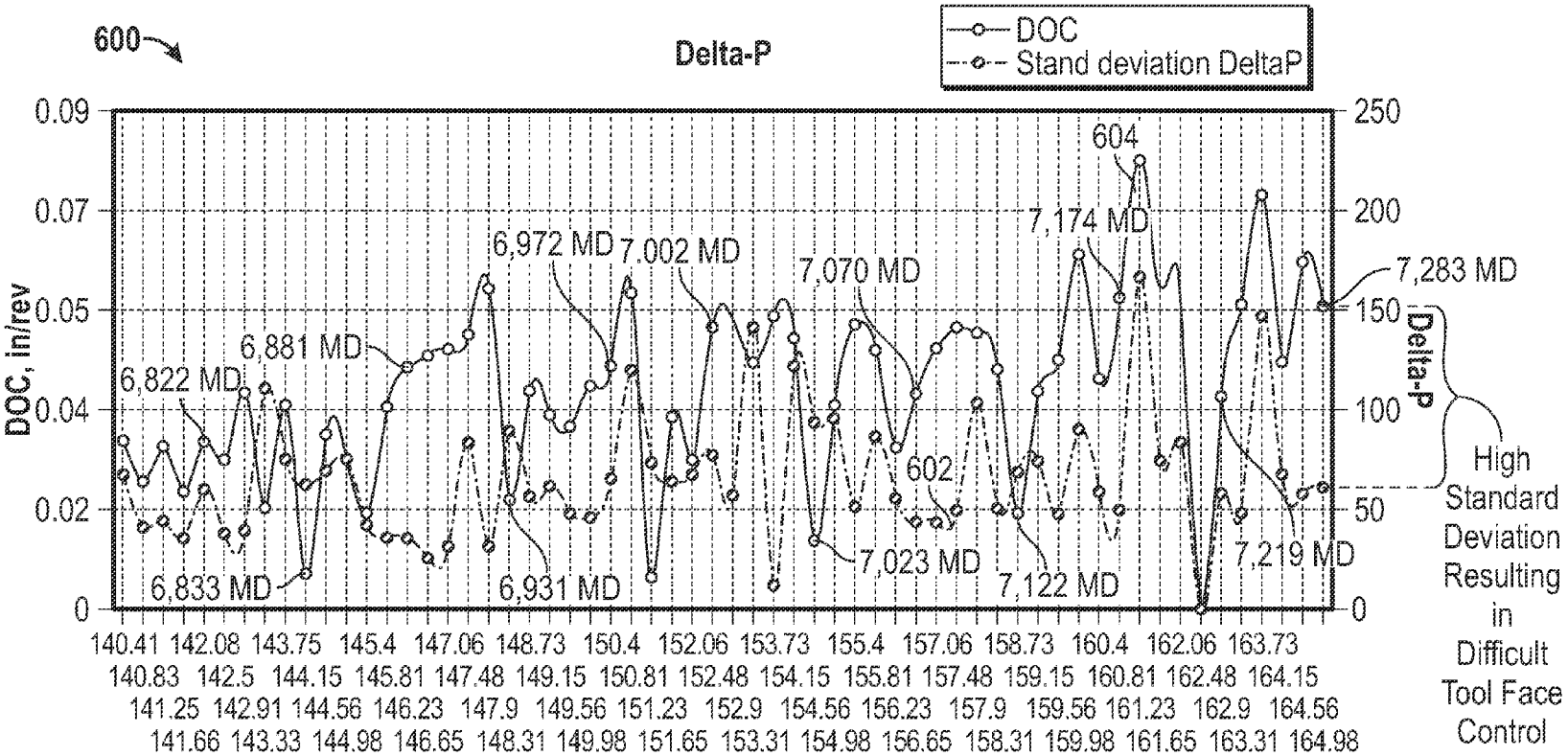
FIG. 6 shows a graph of exemplary parameters related to a high-variation tool face angle obtained using the methods described herein.

FIG. 6 shows a graph 600 of exemplary parameters related to a high-variation tool face angle obtained using the methods described herein. The time duration of drilling is shown along the x-axis in hours. A third curve 602 indicates standard deviation of mud pressure difference ($\sigma_{\Delta P}$) and its numerical values are indicated on the y-axis at the right hand side of the graph. A fourth curve 604 indicates depth-of-cut and its numerical values are indicated on the y-axis at the left-hand side of the graph. Values for third curve 602 are mostly in a range above about 50 psi, indicating high oscillations or a poorly-behaved tool face. For a drill bit having these high-level tool face oscillations, typically an action is taken to alter a drilling parameters to reduce the size of the standard deviation of the pressure. The third curve 602 fluctuates more than first curve 502 of FIG. 5. Fourth curve 604 indicates a depth-of-cut varying from about 0.02 inches per revolution to about 0.05 inches per revolution, which is less than the average 0.05 inches per revolution of the second curve 504 of FIG. 5. Fourth curve 604 corresponds to high variation in the tool face angle and exhibits erratic drilling in comparison to the second curve 504 of FIG. 5.

Therefore, in one aspect, the present disclosure provides a method of drilling a wellbore, the method including: supplying a fluid to a drilling assembly in the wellbore; obtaining a plurality of measurements of fluid pressure of the supplied fluid; estimating a standard deviation of the fluid pressure from the plurality of the measurements of the fluid pressure; estimating a variation of a tool face angle of the drilling assembly using the estimated standard deviation of the fluid pressure; and altering a drilling parameter based on the estimated variation of the tool face angle to drill the wellbore. In one embodiment, the measurements of the fluid pressure in the plurality of measurements of fluid pressure includes a difference between fluid pressure during an off-bottom condition of the drill bit and a fluid pressure during an on-bottom condition of the drill bit. Estimating the variation of the tool face angle of the drilling assembly may include comparing the estimated standard deviation of the fluid pressure to a selected pressure. The selected pressure may be from about 50 psi to about 75 psi. Estimating the variation of the tool face angle may include estimating a degree of oscillation of the tool face angle about a median value of the tool face angle. A build-up rate of the wellbore may be estimated using the estimated variation of the tool face angle. In one embodiment, obtaining the plurality of measurements of fluid pressure of the supplied fluid may include measuring the fluid pressure at a surface location. Estimating the standard deviation of the fluid pressure from the plurality of the measurements of the fluid pressure may include estimating the standard deviation of fluid pressure every 20 minutes to about every 30 minutes and obtaining the at least one measurement of mud pressure of the plurality of measurements of the pressure about every 1 second to about every 20 seconds.

In another aspect, the present disclosure provides an apparatus for drilling a wellbore, the apparatus including: a drilling assembly in the wellbore; a pressure sensor configured to obtain measurements of pressure of a fluid flowing through the drilling assembly; and a processor configured to: estimate a standard deviation of the pressure measurements of the fluid flowing through the drilling assembly, estimate a variation of a tool face angle of the drilling assembly from the estimated standard deviation, and alter a drilling parameter based on the estimated variation of the tool face angle to drill the wellbore. The processor may further determine a difference between a measurement of pressure of the fluid obtained during an off-bottom condition of a drill bit at an end of the drilling assembly and a measurement of pressure of the fluid obtained during an on-bottom condition of the drill bit. The processor may further estimate the variation of the tool face angle from a comparison of the standard deviation of the pressure measurements to a selected pressure. The selected pressure is generally from between about 50 psi and about 75 psi. The processor may further estimate a build-up rate of the wellbore based on the estimated variation of the tool face angle. The processor may further estimate the variation of the tool face angle as a degree of oscillation of the tool face angle about a median value of the tool face angle. The processor may estimate the standard deviation of pressure of the fluid at an interval from about every 20 minutes to about every 30 minutes using the at least one measurement of the pressure of the fluid obtained at an interval from about every 1 second to about every 20 seconds. In one embodiment, the pressure sensor is disposed at a surface location.

In yet another aspect, the present disclosure provides a computer-readable medium having instructions stored therein which enable a processor having access to the instructions to perform a method of drilling a wellbore, the method including: receiving measurements of pressure of a fluid supplied to a drilling assembly deployed in the wellbore; estimating a standard deviation of the measurements of pressure; estimating a variation of a tool face angle of the drilling assembly from the estimated standard deviation of measurements of pressure; and altering a drilling parameter based on the estimated variation of the tool face angle of the drilling assembly to drill the wellbore.

In another aspect, the present disclosure provides a method of estimating a variation of a tool face angle of a drilling assembly in a wellbore, the method including: obtaining pressure measurements of a fluid flowing through the drilling assembly using a sensor; estimating a standard deviation of the pressure measurements, and estimating a variation of a tool face angle of the drilling assembly from the estimated standard deviation. Estimating the variation of the tool face angle of the drilling assembly may include comparing the estimated standard deviation of the fluid pressure to a selected pressure as well as estimating a degree of oscillation of the tool face angle about a median value of the tool face angle.

While the foregoing disclosure is directed to the preferred embodiments of the disclosure, various modifications will be apparent to those skilled in the art. It is intended that all variations within the scope and spirit of the appended claims be embraced by the foregoing disclosure.

What is claimed is:

1. A method of drilling a wellbore, comprising:

supplying a fluid to a drilling assembly in the wellbore;

obtaining a plurality of measurements of fluid pressure of the supplied fluid;

estimating a standard deviation of the fluid pressure from the plurality of the measurements of the fluid pressure;

estimating a variation of a tool face angle of the drilling assembly using the estimated standard deviation of the fluid pressure; and altering a drilling parameter based on the estimated variation of the tool face angle to drill the wellbore.

2. The method of claim 1, wherein the measurements of the fluid pressure in the plurality of measurements of fluid pressure comprises a difference between fluid pressure during an off-bottom condition of the drill bit and a fluid pressure during an on-bottom condition of the drill bit.

3. The method of claim 1, wherein estimating the variation of the tool face angle of the drilling assembly further comprises comparing the estimated standard deviation of the fluid pressure to a selected pressure.

4. The method of claim 3, wherein the selected pressure is from about 50 psi to about 75 psi.

5. The method of claim 1 further comprising estimating a build-up rate of the wellbore using the estimated variation of the tool face angle.

6. The method of claim 1, wherein estimating the variation of the tool face angle further comprises estimating a degree of oscillation of the tool face angle about a median value of the tool face angle.

7. The method of claim 1, wherein obtaining the plurality of measurements of fluid pressure of the supplied fluid comprises measuring the fluid pressure at a surface location.

8. The method of claim 1 wherein estimating the standard deviation of the fluid pressure from the plurality of the measurements of the fluid pressure comprises estimating the standard deviation of fluid pressure every 20 minutes to about every 30 minutes and obtaining measurements of the fluid pressure about every 1 second to about every 20 seconds.

9. An apparatus for drilling a wellbore, comprising:

a drilling assembly in the wellbore;

a pressure sensor configured to obtain measurements of pressure of a fluid flowing through the drilling assembly; and a processor configured to:

estimate a standard deviation of the pressure measurements of the fluid flowing through the drilling assembly, estimate a variation of a tool face angle of the drilling assembly from the estimated standard deviation, and alter a drilling parameter based on the estimated variation of the tool face angle to drill the wellbore.

10. The apparatus of claim 9, wherein the processor is further configured to determine a difference between a measurement of pressure of the fluid obtained during an off-bottom condition of a drill bit at an end of the drilling assembly and a measurement of pressure of the fluid obtained during an on-bottom condition of the drill bit.

11. The apparatus of claim 9, wherein the processor is further configured to estimate the variation of the tool face angle from a comparison of the standard deviation of the pressure measurements to a selected pressure.

12. The apparatus of claim 11, wherein the selected pressure is from between about 50 psi and about 75 psi.

13. The apparatus of claim 9, wherein the processor is further configured to estimate a build-up rate of the wellbore based on the estimated variation of the tool face angle.

14. The apparatus of claim 9, wherein the processor is further configured to estimate the variation of the tool face angle as a degree of oscillation of the tool face angle about a median value of the tool face angle.

15. The apparatus of claim 9, wherein the pressure sensor is disposed at a surface location.

16. The apparatus of claim 9, wherein the processor is further configured to estimate the standard deviation of pressure of the fluid at an interval from about every 20 minutes to about every 30 minutes using measurements of the pressure of the fluid obtained at an interval from about every 1 second to about every 20 seconds.

17. A computer-readable medium having instructions stored therein which enable a processor having access to the instructions to perform a method of drilling a wellbore, the method comprising:

receiving measurements of pressure of a fluid supplied to a drilling assembly deployed in the wellbore;

estimating a standard deviation of the measurements of pressure;

estimating a variation of a tool face angle of the drilling assembly from the estimated standard deviation of measurements of pressure; and altering a drilling parameter based on the estimated variation of the tool face angle of the drilling assembly to drill the wellbore.

18. A method of estimating a variation of a tool face angle of a drilling assembly in a wellbore, comprising:

obtaining pressure measurements of a fluid flowing through the drilling assembly using a sensor;

estimating a standard deviation of the pressure measurements, and estimating a variation of the tool face angle of the drilling assembly from the estimated standard deviation.

19. The method of claim 18, wherein estimating the variation of the tool face angle of the drilling assembly further comprises comparing the estimated standard deviation of the fluid pressure to a selected pressure.

20. The method of claim 19, wherein estimating the variation of the tool face angle further comprises estimating a degree of oscillation of the tool face angle about a median value of the tool face angle.

* * * * *